US008197678B2

(12) United States Patent
Warwick et al.

(10) Patent No.: US 8,197,678 B2
(45) Date of Patent: Jun. 12, 2012

(54) REFINING COAL-DERIVED LIQUID FROM COAL GASIFICATION, COKING AND OTHER COAL PROCESSING OPERATIONS

(75) Inventors: James S. Warwick, Doylestown, PA (US); James P. Frederick, Gillette, WY (US)

(73) Assignee: MR & E, Ltd., Perryburg, OH (US)

( * ) Notice: Subject to any disclaimer, the term of this patent is extended or adjusted under 35 U.S.C. 154(b) by 4 days.

(21) Appl. No.: 13/069,870

(22) Filed: Mar. 23, 2011

(65) Prior Publication Data

US 2011/0168541 A1 Jul. 14, 2011

Related U.S. Application Data

(62) Division of application No. 12/190,271, filed on Aug. 12, 2008.

(51) Int. Cl.
*C10G 1/02* (2006.01)
*C10G 1/04* (2006.01)

(52) U.S. Cl. ..... 208/435

(58) Field of Classification Search ..... 208/435
See application file for complete search history.

(56) References Cited

U.S. PATENT DOCUMENTS

| | | | |
|---|---|---|---|
| 1,814,980 | A | 7/1931 | Wessel |
| 1,976,908 | A | 10/1934 | Wittenberg |
| 2,029,883 | A | 2/1936 | MacCubbin et al. |
| 2,040,100 | A | 5/1936 | Miller |
| 2,044,764 | A | 6/1936 | Bywater |
| 2,260,072 | A | 10/1941 | Wilton |
| 2,366,900 | A | 1/1945 | Weir |
| 2,528,553 | A | 11/1950 | Royster |
| 2,666,796 | A | 1/1954 | Gorin et al. |
| 2,693,409 | A | 11/1954 | Stephens, Jr. |
| 2,748,063 | A | 5/1956 | Radasch |
| 2,774,716 | A | 12/1956 | Kulik |
| 3,010,893 | A | 11/1961 | Kulik |
| 3,375,175 | A | 3/1968 | Eddinger et al. |
| 3,463,310 | A | 8/1969 | Ergun et al. |
| 3,574,065 | A | 4/1971 | Eddinger et al. |
| 3,585,732 | A | 6/1971 | Itahashi |
| 3,736,233 | A | 5/1973 | Sass et al. |

(Continued)

OTHER PUBLICATIONS

Berkowitz N., An Introduction to Coal Technology, 1994, 2nd Edition, pp. 102-103; 164-165.

(Continued)

*Primary Examiner* — Randy Boyer
(74) *Attorney, Agent, or Firm* — MacMillan, Sobanski & Todd, LLC

(57) ABSTRACT

A method of treating a coal-derived liquid byproduct from a coal gasification process includes subjecting the coal-derived liquid to a vacuum distillation process, thereby separating the coal-derived liquid into condensed gas and coal-derived liquid bottoms. The coal-derived liquid bottoms are mixed with a bottoms solvent capable of dissolving the coal-derived liquid bottoms. The solvent/bottoms mixture is introduced along with a linear chain hydrocarbon solvent into a liquid extractor. The Raffinate is separated from the solvent for the coal-derived liquid/bottoms mixture, thereby producing in a heavy extract. The condensed gas is subjected to atmospheric distillation producing a bottoms fraction and another condensed fraction. The bottoms fraction may be used as fuel or for diesel fuel production. The condensed fraction is extracted with a linear hydrocarbon solvent in an extractor to produce light neutral oil and a Raffinate which is a cresylic acid feed stock.

16 Claims, 4 Drawing Sheets

U.S. PATENT DOCUMENTS

| | | | | | |
|---|---|---|---|---|---|
| 3,938,966 | A | | 2/1976 | Kindig et al. | |
| 4,028,219 | A | * | 6/1977 | Baldwin et al. | 208/424 |
| 4,036,603 | A | | 7/1977 | Bernet et al. | |
| 4,052,170 | A | | 10/1977 | Yan | |
| 4,119,523 | A | * | 10/1978 | Baldwin et al. | 208/424 |
| 4,146,367 | A | | 3/1979 | Hsu | |
| 4,149,939 | A | | 4/1979 | Solano | |
| 4,213,826 | A | | 7/1980 | Eddinger et al. | |
| 4,341,598 | A | | 7/1982 | Green | |
| 4,395,309 | A | | 7/1983 | Esztergar | |
| 4,411,766 | A | | 10/1983 | Garg et al. | |
| 4,411,767 | A | | 10/1983 | Garg | |
| 4,466,362 | A | | 8/1984 | Maxwell et al. | |
| 4,534,847 | A | * | 8/1985 | Roberts et al. | 208/424 |
| 4,605,790 | A | | 8/1986 | Wojtkowski | |
| 4,678,478 | A | | 7/1987 | Kelland | |
| 4,834,650 | A | | 5/1989 | Docherty et al. | |
| 5,017,283 | A | | 5/1991 | Oder | |
| 5,114,700 | A | | 5/1992 | Meihack et al. | |
| 5,127,586 | A | | 7/1992 | Oder | |
| 5,171,406 | A | | 12/1992 | Shang et al. | |
| 5,176,260 | A | | 1/1993 | Oder | |
| 5,240,592 | A | | 8/1993 | Meyer et al. | |
| 5,326,457 | A | | 7/1994 | Stipanovich, Jr. | |
| 5,372,497 | A | | 12/1994 | Coolidge et al. | |
| 5,373,648 | A | | 12/1994 | Wolf | |
| 5,401,364 | A | | 3/1995 | Rinker | |
| 5,496,465 | A | | 3/1996 | Fraas | |
| 5,547,549 | A | | 8/1996 | Fraas | |
| 5,601,692 | A | | 2/1997 | Rinker et al. | |
| 5,711,769 | A | | 1/1998 | Rinker et al. | |
| 5,730,069 | A | | 3/1998 | Coolidge et al. | |
| 5,997,289 | A | | 12/1999 | Dover | |
| 2007/0272538 | A1 | | 11/2007 | Satchell | |
| 2011/0011720 | A1 | | 1/2011 | Rinker | |

OTHER PUBLICATIONS

Dadayburjor, et al., Coal Conversion Processes Liquefaction, Kirk-Othmer Encyclopedia of Chemical Technology, 2003, vol. 6, pp. 851-856.

Kreith, F., Principles of Heat Transfer, 2nd Ed. 1965, pp. 236-238.

Mahajan O. et al., Low-temperature air oxidation of caking coals. 1. Effect on subsequent reactivity of chars produced, FUEL, 1980, vol. 59, January, pp. 3-10.

Oder, R., Dry magnetic Separation of Ash, Sulfur, and Mercury From a Southwestern Wyoming Coal, presented at the 18th International Low Rank Fuels Symposium, Jun. 24-26, 2003, Billings, Mt, pp. 1-6.

The International Search Report and the Written Opinion, PCT/US2010/041918, dated Feb. 24, 2011.

* cited by examiner

REFINING COAL-DERIVED LIQUID FROM COAL GASIFICATION, COKING AND OTHER COAL PROCESSING OPERATIONS

RELATED APPLICATIONS

This application is a divisional patent application of U.S. patent application Ser. No. 12/190,271, filed Aug. 12, 2008, and entitled REFINING COAL-DERIVED LIQUID FROM COAL GASIFICATION, COKING, AND OTHER COAL PROCESSING OPERATIONS, the disclosure of which is incorporated herein by reference.

TECHNICAL FIELD

This invention relates to a method of processing byproducts from coal is processing to make higher value products. More particularly, this invention pertains to processes and apparatus for distilling and separating a coal-derived liquid (CDL) product stream into various higher value products.

BACKGROUND OF THE INVENTION

Coal in its virgin state is sometimes processed to improve it's usefulness and thermal energy content. The processing can include drying the coal and subjecting the coal to a pyrolysis process to drive off low boiling point organic compounds and heavier organic compounds. Coal is sometimes also subjected to coal gasification and coking operations which produce gas, liquid, and solid products. The liquid product or CDL is a coal tar or coal liquid and is not suitable as a feedstock for typical petroleum refinery operations due to the high oxygen and nitrogen content and its acid number. It may be used as a fuel but its value is typically less than bunker C oil. Its value is also reduced because it is not generally compatible with and can not be blended with most petroleum based fuels.

It would be advantageous if the CDL could be processed into higher value products.

SUMMARY OF THE INVENTION

According to this invention there is provided a method and apparatus for separating coal-derived liquid byproducts from a mild coal gasification process into more to valuable components, such as, for example, pitches, waxes, refinery feed stock, oil, aromatic alcohols and cresylic acids.

In one embodiment, the method includes a combination of vacuum and atmospheric distillations as well as extraction of the distillates and bottoms with appropriate solvents and at the appropriate operating conditions to isolate and recover is valuable by-products.

According to one embodiment of this invention, a method of treating a coal-derived liquid byproduct from a coal gasification process includes subjecting the coal-derived liquid to a vacuum distillation process, thereby separating the coal-derived liquid into condensed gas and coal-derived liquid bottoms. The coal-derived liquid bottoms are mixed with a bottoms solvent capable of dissolving the coal-derived liquid bottoms. The solvent/bottoms mixture is introduced along with a linear chain hydrocarbon solvent into a liquid extractor. The Raffinate is separated from the solvent for the coal-derived liquid/bottoms mixture, thereby producing a heavy extract.

According to another embodiment of the invention, a method of treating a coal-derived liquid byproduct from a coal gasification process includes subjecting the coal-derived liquid to a vacuum distillation process, thereby separating the coal-derived liquid into condensed gas and coal-derived liquid bottoms. The condensed gas is subjected to an atmospheric distillation process, thereby producing light cut byproducts, distillate middle cut byproducts, and bottoms. The middle cut byproduct is treated by subjecting it, along with a linear chain hydrocarbon solvent, to a liquid extraction process, thereby producing a middle cut extract and Raffinate. The middle cut extract is subjected to a distillation process to remove the linear chain hydrocarbon solvent, thereby forming cresylic acid feedstock.

Various advantages of this invention will become apparent to those skilled in the art from the following detailed description of the preferred embodiment, when read in light of the accompanying drawings.

DETAILED DESCRIPTION OF THE INVENTION

The method and apparatus of the invention pertain to treating coal-derived liquid (CDL) byproduct from a mild coal gasification process and/or coal coking operations. Coal gasification and coking operations produce gas, liquid, and solid products. The liquid product is called coal tar or coal liquid, and is not suitable as a feedstock for typical petroleum refinery operations due to the high oxygen and nitrogen content and its acid number. It may be used as a fuel but its value is typically less than bunker C oil. Its value is also reduced because it is not generally compatible with and cannot be blended with most petroleum based fuels.

The method and apparatus disclosed in this specification include a process to upgrade coal tar liquids produced from the gasification of low rank coal or from mild coal coking operations to produce a product slate with considerably more value. The upgrading scheme may involve both vacuum and atmospheric distillation operations, and extraction operations. Products that may be produced include, but are not limited to, cresylic acid feed stock, transportation fuel feed stock, Montan like wax, and pitch for various purposes, such as, for example, anode production.

Figure 1:
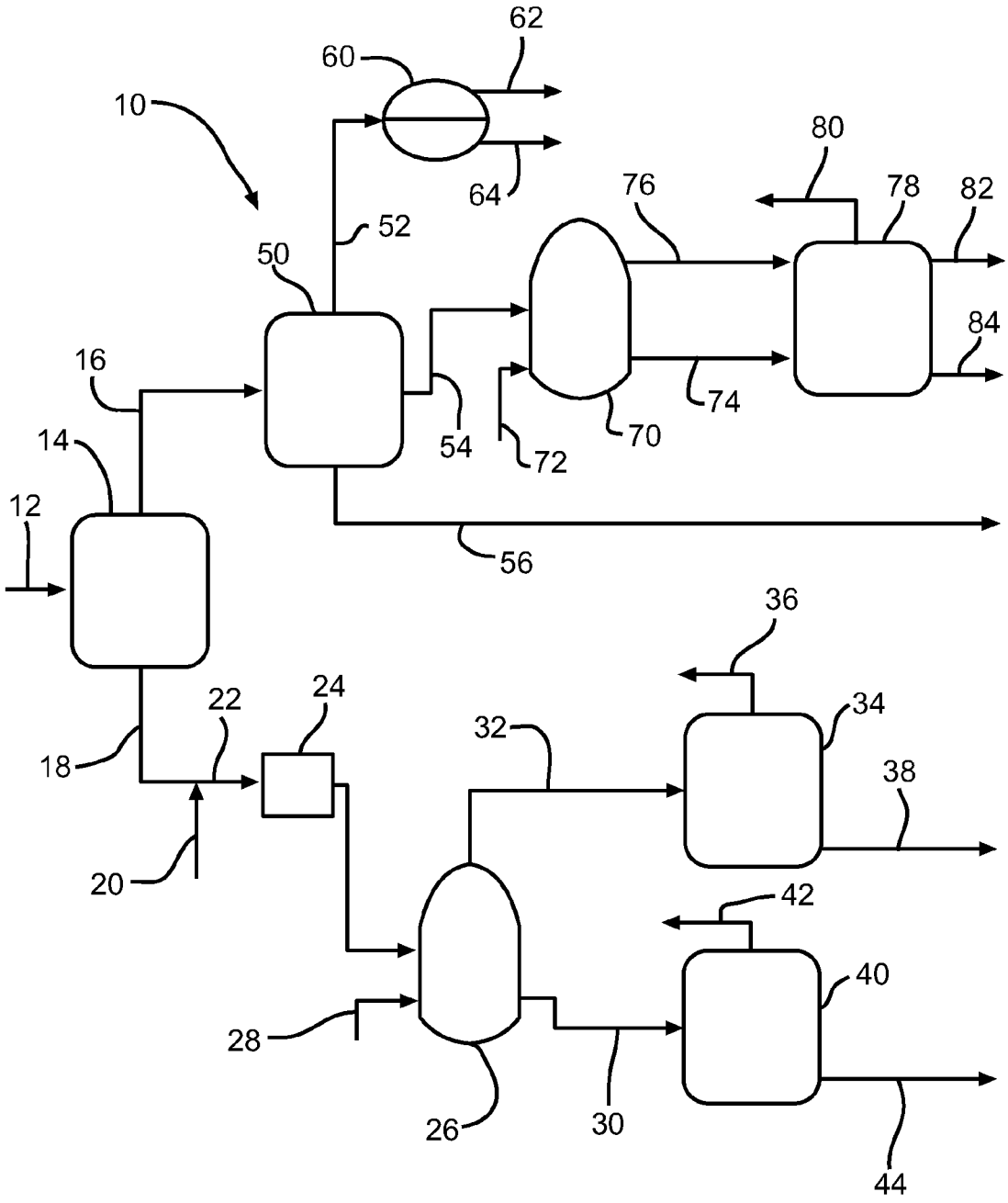
FIG. 1 is a schematic view of apparatus and a process for treating coal-derived liquid.

As shown in FIG. 1, a process for treating CDL feedstock is indicated at 10. A supply 12 of CDL is first introduced to a vacuum distillation apparatus, indicated at 14. Optionally, the CDL feedstock is filtered or centrifuged to remove particulate matter, such as coal fines. The CDL feedstock can be a product of a coal gasification process or of a coking operation, or both.

The distillation apparatus 14 can be a vacuum distillation tower that is configured to separate the heavy ends containing the pitch and wax fractions from the lighter components including water. Vacuum distillation towers are well known in the art. In one embodiment the tower operates at pressure of about 20 kPa (150 mm Hg), although other pressures, higher or lower, could also be used. In this embodiment, the distillation apparatus 14 is operated at a temperature less than or equal to about 260° C. To assure temperature control, in this embodiment the re-boiler is heated with an indirectly heated hot oil system rather than a direct fired system. The pitch portion in the bottoms may decompose to form coke if heated above 260° C. Hot oil is used so as not to decompose the pitch contained in the CDL. Pitch forms coke at temperatures present if direct fired heating is used.

The distillation apparatus 14 separates the heavy ends containing the pitch and wax fractions from the lighter components including water, thereby separating the CDL supply stream into an overhead stream 16 of condensed gases and a remainder stream 18 of CDL bottoms. In this embodiment, about 30 percent by weight of the entering CDL material goes overhead as the stream 16 of condensed gases, and the remainder is the bottoms product 18. All percentages expressed in this specification are in terms of weight percent, unless otherwise stated. In one embodiment the stream of condensed gases 16 has a boiling point range of 104° to 290° C.

As further shown in FIG. 1, the bottoms product 18 is further processed by diluting it 1:1 by weight with a stream 20 of N-methylpyrrolidone (NMP-$C_5H_9NO$), to reduce the viscosity of the bottoms product 18, thereby forming a diluted bottoms mixture 22. Other diluents could be used as long as they are miscible with the CDL bottoms and would not be soluble in heptane. NMP was used because of availability, reasonable cost and low losses in the process. Alternative diluents should be capable of dissolving the coal-derived liquid, but not be soluble in the heptane or other linear chain hydrocarbon solvent chosen for dissolving the wax. Alternative coal-derived liquid diluents for the CDL bottoms include 2-pyrrolidone. Optionally, a mixer 24 can be used for mixing the bottoms 18 and NMP. The NMP/bottoms mixture 22 is then introduced to a liquid extractor 26. A stream 28 of n-heptane or other suitable solvent is also introduced into the liquid extractor 26 in a 1:1 solvent to bottoms ratio. Alternatives to heptane as a solvent include solvents that are linear chain hydrocarbons having 6 to 12 carbon atoms, such as, for example, octane. The liquid extractor 26 can be a counter current packed extractor column, or any other suitable column. The liquid extractor 26 is operated at atmospheric pressure, and at a temperature of about 40° C., although other pressures and temperatures can be used. The extractor separates a stream 30 of Raffinate from an overhead stream 32 of liquid extract in a liquid/liquid extraction process. The Raffinate is not soluble in heptane.

The liquid extract 32 is then optionally treated with a vacuum distillation process, indicated at 34, to recover the heptane 36, with the remainder being a stream 38 of wax. In one embodiment, the resulting wax is a low melting point, high boiling point, high reactivity wax, with the wax being in an amount of about 30 percent by weight of the CDL feedstock. The heptane/wax tower 34 can be operated at 20 kPa and 260° C., or any other suitable temperature and pressure. Both the pitch and wax solvent recovery columns 34, 40 can be equipped with reboilers and may require supplemental heat from a heat source, such as a hot oil system.

The wax product is technically a mineral wax but differs from Montan lignite waxes in that it has a broader and lower melting range. This material can be marketed as a Montan wax, which is in short supply, and the cost to produce this material is much lower than the cost to produce Montan wax by the extraction from lignite. This wax has broad industrial application, as it falls into the category of "Slack Waxes" which are derived from the removal of paraffins from lube oil base stocks in petroleum refining. Since this wax is miscible with other waxes and oils commonly found in industrial wax formulations, the wax can be used as an extender stock. The wax was tested for a binder in fire logs and particle boards, and found to be better than any previous wax blend available.

The Raffinate 30 from the NMP/bottoms mixture produced by the liquid extractor 26 is then supplied to a vacuum distillation apparatus 40 to recover the NMP, as indicated at 42, with the remainder being a stream 44 of pitch. The vacuum distillation tower 40 can be operated at 20 kPa and a little over 260° C., although other temperatures and pressures can be used. The coal tar pitch from stream 44 is valuable as a binding agent for electrodes for aluminum and electric arc steel production. The pitch fraction may also be further calcined or processed to produce activated carbon for the body of anodes or other applications. In one embodiment the pitch yield is expected to be around 47 percent by weight of the CDL feedstock. The recovered heptane stream 36 and NMP stream 42 can be recycled back into the process.

As further shown in FIG. 1, the overhead stream 16 of condensed gases from the primary vacuum distillation tower 14 can be subjected to distillation in an atmospheric distillation tower 50, operating with a 260° C. bottom temperature. The results of the atmospheric distillation in the tower 50 are a stream 52 of the lightest ends or overhead boiling up to about 104° C., a stream 54 of middle cut byproducts boiling from about 104° C. to about 227° C., and the remainder, a stream of bottoms 56.

The stream 52 of the overhead from the atmospheric distillation tower 50 is primarily water with some light oils, and is processed through a decanting process indicated at 60 to separate a decant oil stream 62 from a stream 64 of process water. The decant oil stream can be used as input for a diesel fuel production process, as well as other refinery feedstock uses, and additional uses in other areas.

The middle cut distillate byproducts 54 is a light distillate that boils from 104° to 227° C. and is the precursor of the cresylic acid feedstock. The middle cut stream 54 can be further processed in a liquid extractor 70. The middle cut stream 54 is introduced into the extractor 70 along with a stream 72 of heptane or other suitable solvent. The liquid extractor 70 can be a counter current packed extractor column, or any other suitable column. The liquid extractor 70 is operated at atmospheric pressure, and at a temperature of about 40° C., although other pressures and temperatures can be used. The heptane dissolves the light neutral oils, but does not dissolve the cresylic acid. The extractor 70 separates a stream 74 of Raffinate from an overhead stream 76 of liquid extract. The heptane dissolves light neutral oils, but not cresylic acid. The Raffinate 74 is then optionally treated with a vacuum distillation process, indicated at 78, to recover the heptane 80, with the remainder being a stream 82 of cresylic acid feed stock.

The cresylic acid 82 is valuable in a number of markets, including, but not limited to, the plastics, electronics and pharmaceutical industries. The vacuum distillation is process can be carried out in the vacuum distillation tower 78 in a batch mode or in a continuous mode. It is expected that by undertaking the vacuum distillation in the vacuum tower 14 to separate the light and heavy ends before the atmospheric distillation in atmospheric tower 50 to remove water and cresylic acid fractions (streams 52 and 54), the eventual cresylic acid stream 82 will have a concentration of approximately 86 percent, in contrast to prior processes that produced cresylic acid with a concentration of only 60 percent. More specifically, 86 percent by weight of the stream 82 is comprised of isomers of cresol with the principle impurities being other phenols. In a separate process, not shown, this cresylic acid feedstock 82 can be separated into individual isomers with high purity requirements for use in a wide variety of industrial applications. This material is in high demand in the United States as an intermediate in the production of resins, dyes, fragrances, deodorizers, insecticides, adhesives and coatings for electronics.

The stream of liquid extract 76 can also be optionally treated with a vacuum distillation process, and the same apparatus, i.e., vacuum distillation tower 78, can be used as for the treatment of the overhead stream 76 of the liquid extract. Alternatively, a different distillation tower can be used. The distillation of the overhead 76 in the distillation tower 78 results in the recovery of heptane 80 and a stream 84 of light neutral oil, which will have a number of uses, including input for a diesel fuel production process, as well as other refinery feedstock uses and other uses. In one embodiment this light neutral oil has a boiling from 104° to 227° C. This product contains a substantial amount of substituted benzene compounds. The yield of this product in one embodiment is estimated to be around 2.4 percent by weight of the feedstock CDL. Distillation tower 78 can be a rotating disk contactor, or any other suitable separation mechanism. This process can be carried out in the vacuum distillation tower 78 in a batch mode or in a continuous mode. As a practical matter, a single distillation tower 78 can be used alternatively for distillation of the overhead stream 76 and the Raffinate 74.

The bottoms 56 from the atmospheric distillation process are a middle distillate that boils from 227° to 288° C. and can be used directly for fuel or input to a diesel fuel production process, or further separated by atmospheric distillation. Optionally, the bottoms 56 can be separated into middle oil and middle polars by a heptane extraction process.

The bottoms 56 would only be further processed in an extractor if it is desired to produce a middle polar product that may be marketed at a higher value than diesel fuel. If not, the bottoms 56 would be marketed as a fuel oil blend stock directly. In one embodiment, the overall yield of the bottoms 56 is 17 percent. If subjected to a polar/middle oil extraction column, the expected yield in one embodiment would be 6 percent for the middle oil and 11 percent for the middle polar fraction. The middle oil has utility as an industrial fuel cutter stock and may find application as input to diesel fuel production. The middle polars fraction has value as fuel, but in addition it contains valuable compounds such as catechols, guaichols, resorcinol and a variety of substituted catechols that can be separated by distillation into chemical intermediates.

The light oil 84 and bottoms 56 can be combined for a diesel fuel fraction. Engine tests have been run and even though the cetane rating is atypically low, the fuel burned well. The light oil 84 contains substantial amounts of substituted benzene compounds which are well suited for solvent production. Or, after removal of oxygen compounds this fraction could be used as a refinery feedstock to make gasoline.

An analysis of the process indicates that it is capable of separating the compounds from the crude CDL that contain most of the nitrogen and oxygen from those compounds that don't. The resulting product streams are more valuable because the nitrogen and oxygen content is concentrated in the pitch, middle polar oil and cresylic acid fractions, where such oxygen and nitrogen content is desirable. The diesel fractions and waxes are maintained with relatively low nitrogen and oxygen concentrations, which is also desirable result.

It is to be understood that not all coal tar liquids are applicable to the CDL upgrading process described in this specification. For example, gasification liquids produced from many bituminous coals do not contain the product slate described above. Typically low rank coals such as brown coals, lignite coals, and subbituminous coals produce coal tar liquids which fit the upgrading process. The process described in this specification is not applicable to petroleum based feed stocks. Yields and chemical composition of the various products are dependant on the chemical composition of the source coal and the gasification or coking process used to produce the coal tar liquids (CDL) feedstock. The exact temperatures, pressures, flow rates and solvent ratios would be adjusted within a reasonable range for the composition of the crude CDL being supplied to the process. This composition is very dependent on the feed coal and gasification process being used. Depending on the source coal, CDL and the resulting product fractions can be very low in sulfur which is very desirable for all product streams.

EXAMPLE I

Figure 2:
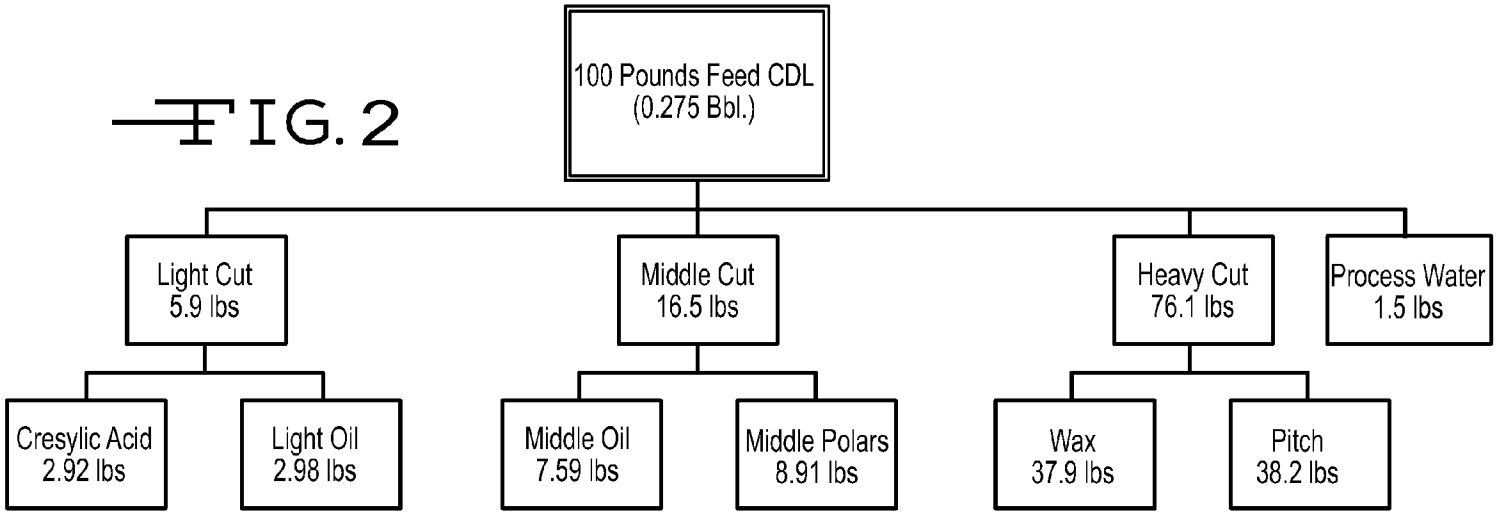
FIG. 2 illustrates the overall mass balance for a CDL treatment process using coal from the northern Powder River Basin in Gillette, Wyo.

The overall mass balance for a successfully demonstrated process is shown in FIG. 2. This balance is specific to CDL produced from northern Powder River Basin (PRB) coal at the ENCOAL Mild Coal Gasification plant in Gillette Wyo. The content of the CDL for Example I is shown in Table 1 below. It is to be understood that CDL recovery and composition is very much a function of the feed coal, and laboratory testing is needed to verify yields for each product for different coals.

EXAMPLE II

Figure 3:
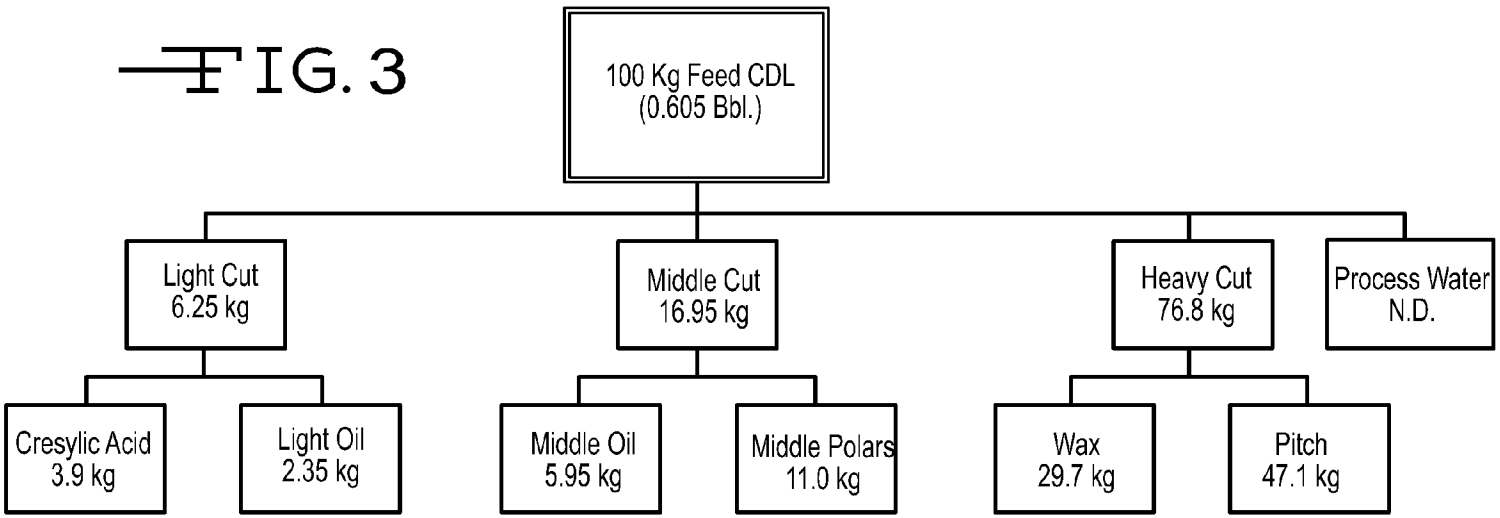
FIG. 3 illustrates the overall mass balance for a CDL treatment process using coal from Inner Mongolia in China.
Figure 4:
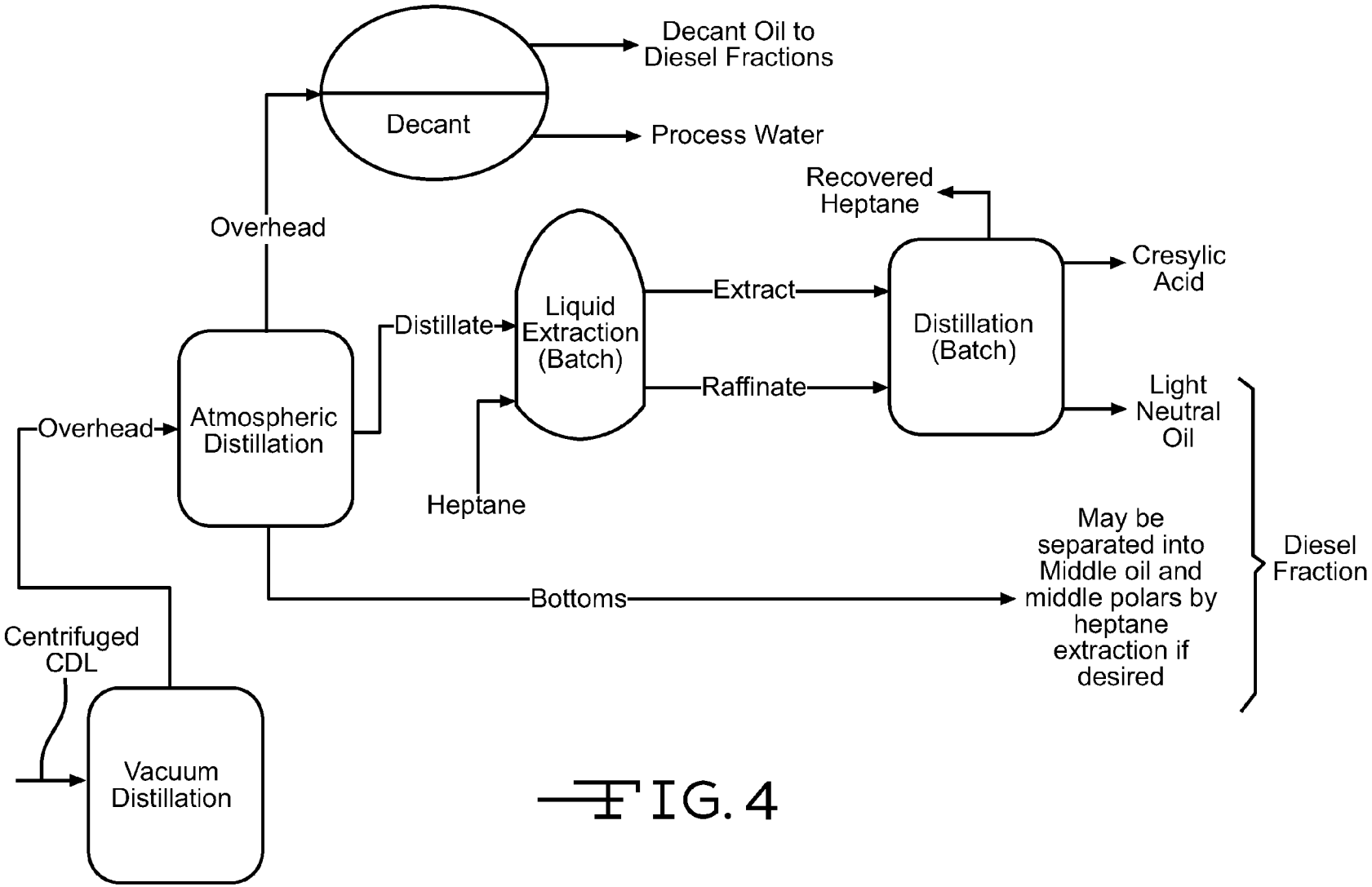
FIG. 4 illustrates a more detailed view of the processing of the lighter components from the vacuum distillation.
Figure 5:
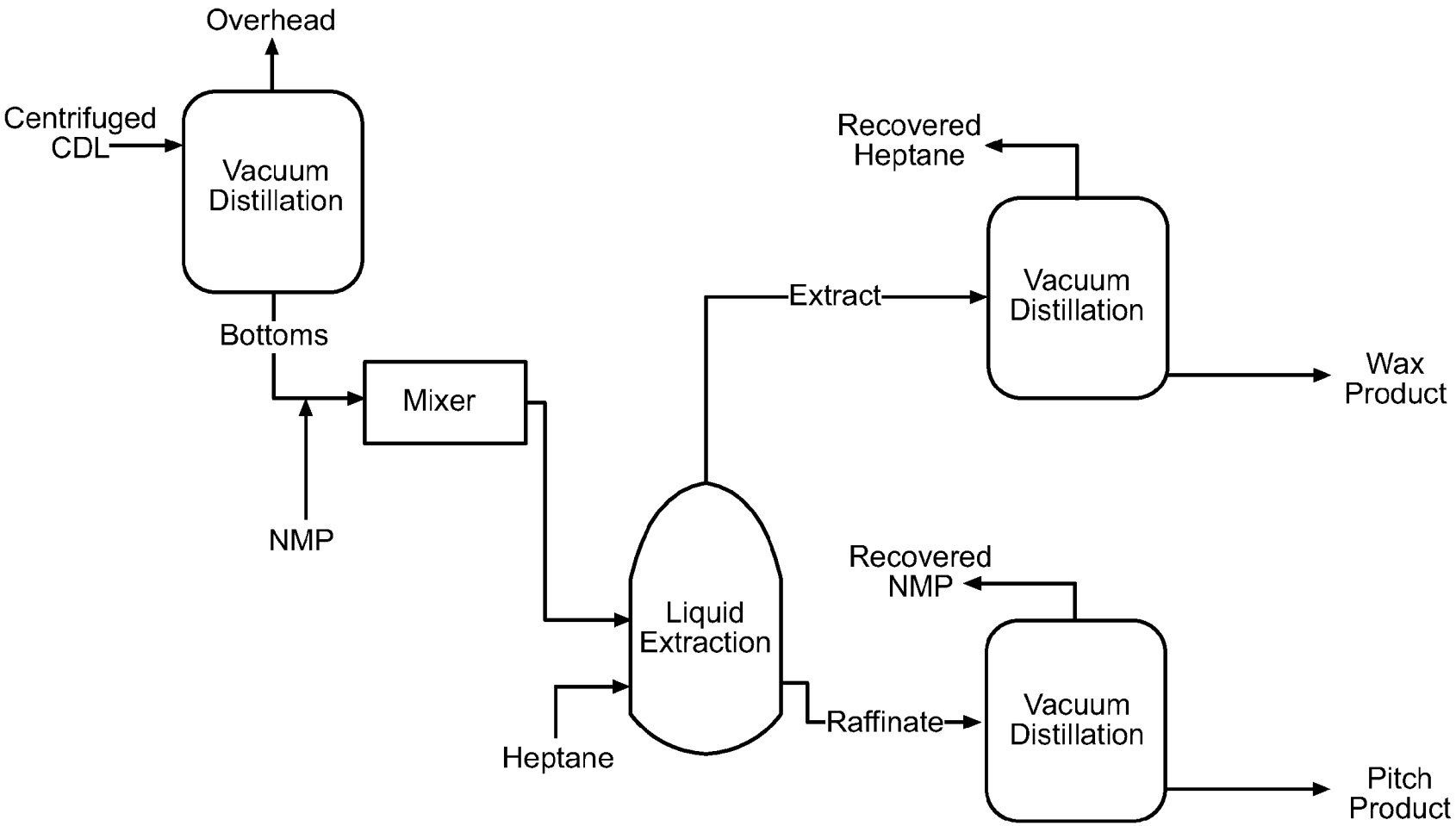
FIG. 5 illustrates a more detailed view of the processing of the heavier components from the vacuum distillation.

The overall mass balance for a different CDL feedstock, from an Inner Mongolian coal in China, is shown in FIG. 3. The content of the CDL for Example II is shown in Table 1 below.

TABLE 1

CDL Feed Characteristics

| | ENCOAL CDL | Chinese CDL |
|---|---|---|
| Gravity (° API): | 0-3 | −2.6 |
| Sulfur (%): | 0.3 | 1.6 |
| Nitrogen (%): | 0.6 | 0.5 |
| Oxygen (%): | 9.0 | 11.7 |
| Viscosity @ 100° C. (cSt) | 12.3 | 10.05 |
| Pour Point (° C.) | 35° | 36° |
| Flash Point (° C.) | 77-104° C. | 119° |
| Heating Value (MJ/L) | 39 | 39 |

The principle and mode of operation of this invention have been described in its preferred embodiments. However, it should be noted that this invention may be practiced otherwise than as specifically illustrated and described without departing from its scope.

What is claimed is:

1. A method of treating a coal-derived liquid byproduct from a coal gasification process comprising:

subjecting the coal-derived liquid to a vacuum distillation process, thereby separating the coal-derived liquid into condensed gas and coal-derived liquid bottoms;

subjecting the condensed gas to an atmospheric distillation process, thereby producing light cut byproducts, middle cut byproducts, and bottoms;

treating the middle cut byproduct by subjecting it, along with a linear chain hydrocarbon solvent, to a liquid extraction process, thereby producing a middle cut extract and Raffinate; and subjecting the middle cut extract to a distillation process to remove the linear chain hydrocarbon solvent, thereby forming cresylic acid feedstock.

2. The method of claim 1 in which the linear chain hydrocarbon solvent is heptane.

3. The method of claim 1 including subjecting the Raffinate to a distillation process to remove the linear chain hydrocarbon solvent, thereby forming oil.

4. The method of claim 1 including subjecting the light cut byproducts to a decanting process to remove process water, thereby forming decant oil.

5. The method of claim 1 whereby the bottoms cut is combined with the light oil and decant oil to form a marketable diesel oil.

6. The method of claim 1 including subjecting the bottoms to extraction with a linear chain hydrocarbon solvent to form an extract and a Raffinate, and subsequently recovering the linear chain hydrocarbon solvent from both streams to produce separate middle oil and middle polars product streams.

7. A method of treating a coal-derived liquid byproduct from a coal gasification process comprising:

subjecting the coal-derived liquid to a vacuum distillation process, thereby separating the coal-derived liquid into condensed gas and coal-derived liquid bottoms;

subjecting the condensed gas to an atmospheric distillation process, thereby producing light cut byproducts, middle cut byproducts, and bottoms;

treating the middle cut byproduct by subjecting it, along with heptane, to a liquid extraction process, thereby producing a middle cut extract and Raffinate; and subjecting the middle cut extract to a distillation process to remove the heptane, thereby forming cresylic acid feedstock.

8. The method of claim 7 including subjecting the Raffinate to a distillation process to remove the linear chain hydrocarbon solvent, thereby forming oil.

9. The method of claim 7 including subjecting the light cut byproducts to a decanting process to remove process water, thereby forming decant oil.

10. The method of claim 7 whereby the bottoms cut is combined with the light neutral oil and decant oil to form a marketable diesel oil.

11. The method of claim 7 including subjecting the bottoms to extraction with a linear chain hydrocarbon solvent to form an extract and a Raffinate, and subsequently recovering the linear chain hydrocarbon solvent from both streams to produce separate middle oil and middle polars product streams.

12. The method of claim 7 including forming cresylic acid from the cresylic acid feedstock.

13. The method of claim 7 in which the cresylic acid feedstock has a cresylic acid concentration of greater than 60 percent.

14. A method of treating a coal-derived liquid byproduct from a coal gasification process comprising:

subjecting the coal-derived liquid to a vacuum distillation process, thereby separating the coal-derived liquid into condensed gas and coal-derived liquid bottoms;

subjecting the condensed gas to an atmospheric distillation process, thereby producing light cut byproducts, middle cut byproducts, and bottoms;

treating the middle cut byproduct by subjecting it, along with heptane, to a liquid extraction process, thereby producing a middle cut extract and Raffinate; and subjecting the middle cut extract to a distillation process to remove the heptane, and subjecting the middle cut extract to a distillation process to remove the linear chain hydrocarbon solvent, thereby forming cresylic acid feedstock.

15. The method of claim 14 including forming cresylic acid from the cresylic acid feedstock.

16. The method of claim 14 in which the cresylic acid feedstock has a cresylic acid concentration of greater than 60 percent.

* * * * *